US005718135A

United States Patent [19]

Bertenshaw et al.

[11] Patent Number: 5,718,135

[45] Date of Patent: Feb. 17, 1998

[54] LOCKS

[75] Inventors: Philip H. Bertenshaw, Marple; Andrew M. Taylor, New Milton, both of United Kingdom

[73] Assignee: Reynolds (UK) Limited, West Midlands, United Kingdom

[21] Appl. No.: 564,580

[22] Filed: Nov. 29, 1995

[51] Int. Cl.[6] ..... E05B 49/00; E05C 3/00

[52] U.S. Cl. ..... 70/278; 70/277; 292/44; 292/45

[58] Field of Search ..... 70/278, 275, 277, 70/279, 280–283; 292/341.17, 44, 45

[56] References Cited

FOREIGN PATENT DOCUMENTS 2278631 12/1994 United Kingdom .

*Primary Examiner*—Steven N. Meyers
*Assistant Examiner*—Tuyet-Phuong Pham
*Attorney, Agent, or Firm*—Leydig, Voit & Mayer, Ltd.

[57] ABSTRACT

An electrically operated door lock has a pair of pivotally mounted jaws (12, 13) which can be moved towards and away from each other to capture and release the end of a bolt or style (11). The bolt or style moves in a direction perpendicular to the direction of movement of the jaws. The jaws are locked in the captive position by a cam (39) which is controlled by a low power electric motor (81). The motor has three positions corresponding to release, locking and deadlocking of the jaws, the jaws being releasable by a handle (49) in the locked position but not when deadlocked. An electronic control system is used to control the motor, and the lock can be released using an electronic coded proximity key.

33 Claims, 8 Drawing Sheets

LOCKS

TECHNICAL FIELD

This invention relates to locks, particularly but not exclusively to door locks for both mechanical and electrical operation having an electronic control in lieu of a mechanical key mechanism.

BACKGROUND ART

Known electrical door locks use a powered solenoid for release of the lock. The solenoid is kept energised to maintain the unlocked state typically for 3 to 10 seconds, and this consumes much energy to the extent that it is impractical to operate the lock with an internal dry cell battery.

Also with known electrical door locks, the mechanism is released electrically but it is then usually necessary to open the lock mechanically e.g. by turning a door knob.

DISCLOSURE OF THE INVENTION

An object of the present invention is to provide a simple and reliable lock mechanism with which secure, relatively tamper proof locking can be achieved, yet which can be suitable for electrical operation with a relatively low power requirement consistent with the use of an internal dry cell battery as the power source, and with which lock release can be readily achieved in a simple manner.

According to one aspect of the invention therefore there is provided a lock mechanism comprising a pair of jaws movable towards and away from each other between a locking position at which a style or bolt is held captive between the jaws, and a release position at which the style or bolt is free to be withdrawn from between the jaws, a movable abutment being provided for controlling locking and release of the jaws. Preferably, the jaws are movable as aforesaid transversely particularly perpendicularly to the direction of withdrawal of the style or bolt, although movement in a different direction e.g. in the same plane is also possible.

With this arrangement, as a consequence of the use of retaining jaws movable transversely to the insertion and withdrawal movement direction of the style or bolt it is possible to achieve strong, secure locking or deadlocking without requiring a powerful release force for unlocking purposes.

The lock is therefore specially suitable for electrical operation with a relatively low power source.

The movable abutment member can permit use of a construction which gives positive release whereby for example a door can be opened by pushing the door and without requiring use of a door knob for lock release.

Preferably the jaws are pivotally movable towards and away from each other. Preferably also the abutment member is engageable with at least one of the jaws, said member being movable between a locking position at which the jaws are held in the said locking position thereof and a release position at which the jaws are free to move to the release position thereof. The abutment member may comprise a cam.

In so far as the style or bolt is imprisoned between the jaws when it enters therein the lock can provide an automatic dead lock. Little force need to required for the style or bolt to enter, but once therein the jaws may interact to imprison the style or bolt firmly therein. As a result, there may be little friction involved so that the component wear can be considerably reduced compared with much of the prior art.

The construction of the lock and particularly the reduced friction allows the use of an electrically operable device for controlling locking and release of the jaws, particularly a low power electric motor to move the cam. Also the lock can be relatively simple and compact compared with known locks so that a minimal level of skill is required for installation.

In a preferred embodiment of the invention the style or bolt is rigidly mounted e.g. on a door frame whilst the jaws are pivotally mounted within the lock and capable of rotating through a defined arc, permitting the jaws to attain a desired position with the style or bolt misaligned within defined limits. That is, the jaws are preferably mounted for movement together for adjustment of the positioning of the jaws in the locking position thereof relative to the style or bolt.

The above mentioned electrically operable device is preferably connected to the abutment member via an elongate link.

Preferably also the electrically operable device has three operational modes corresponding to locked, deadlocked and releasable conditions of the jaws, and a mechanical actuator is provided which is manually operable to release the jaws from the locked but not the deadlocked condition.

One of the jaws may have a hook shaped end portion for engagement with the style or bolt.

Also one of the jaws may have a bar-shaped end portion for engagement with the style or bolt.

In one embodiment the end portion of at least one of the jaws has an inclined surface thereto for sliding engagement with the style or bolt on movement thereof between the jaws to the retained position of the style or bolt. Also the style or bolt may have a hooked end for engagement with the jaws and this hooked end may have a curved surface thereto.

In a preferred embodiment there is a deflector member which is operated by movement of the style or bolt between the jaws to the retained position thereof so as to deflect the abutment member to its release position and allow opening of the jaws to receive the style or bolt.

Preferably the lock mechanism has an electronic control circuit for the electrically operable device, which circuit is actuable by an electronic coded proximity key. The key may be inductively read by the control circuit. The mechanism may include therewithin a battery power source for the electrically operable device.

Preferably also there is provided an electronic control circuit for the electrically operable device, which circuit is actuable by a manual control and which has a visual display device. The control circuit may be operable to invert the presentation of the display of the display device.

Preferably the three operational modes of the electric motor correspond to three operational positions of the motor defined by engagement of a contactor driven by the motor with electrical contacts of an electronic control circuit for the motor.

BRIEF DESCRIPTION OF THE DRAWINGS

The invention will now be described further by way of example only and with reference to the accompanying drawings in which.

BEST MODE OF CARRYING OUT THE INVENTION

Figure 1A:
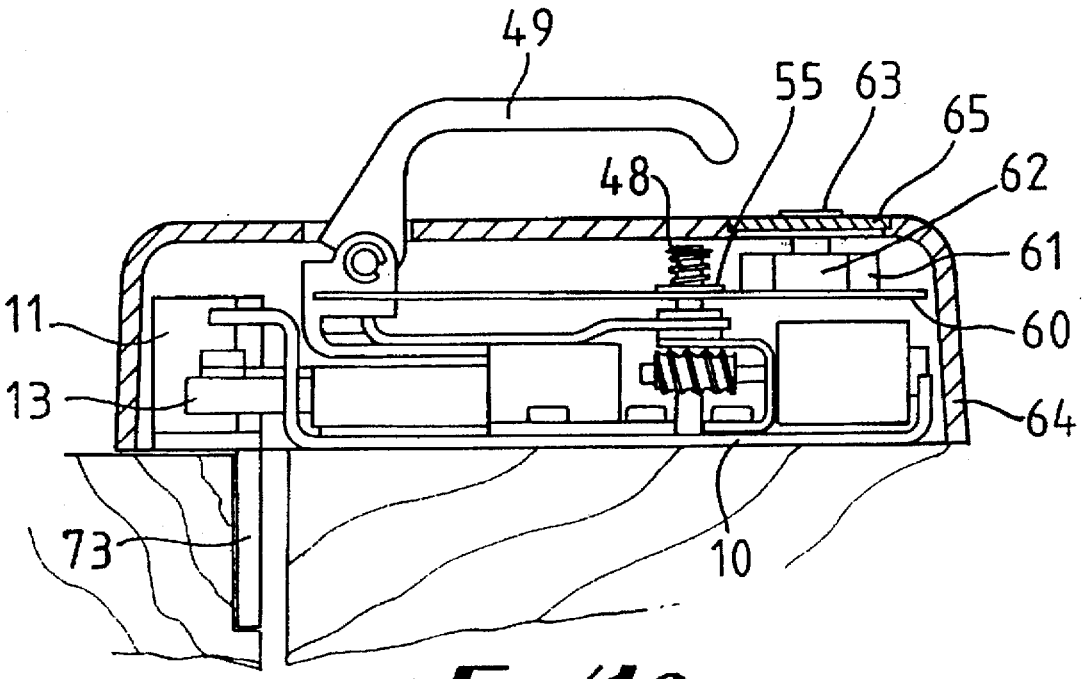
FIG. 1 shows one form of a lock according to the invention in a locked state, FIG. 1*a* being a part-sectioned side view and FIGS. 1*b*–1*d* being part-sectioned plan views at different levels.
Figure 1B:
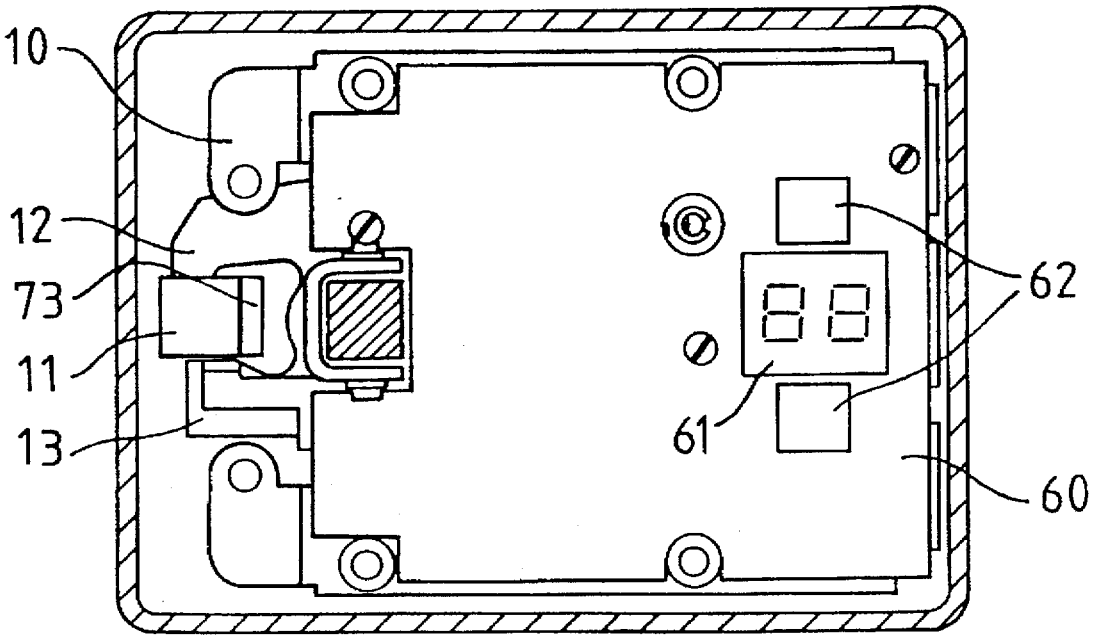

Referring to FIGS. 1*a* and 1*b*, a base plate 10 is mounted on a door, and a staple 11 fixed by a rivet 72 on a locking plate 73 is rigidly mounted on a door frame.

A set of locking jaws, comprising a bolt 12 and a bar 13, is mounted on a common pivot 38 in the lock to create a defined aperture 71 in which the staple 11 can be imprisoned or held captive.

Figure 1C:
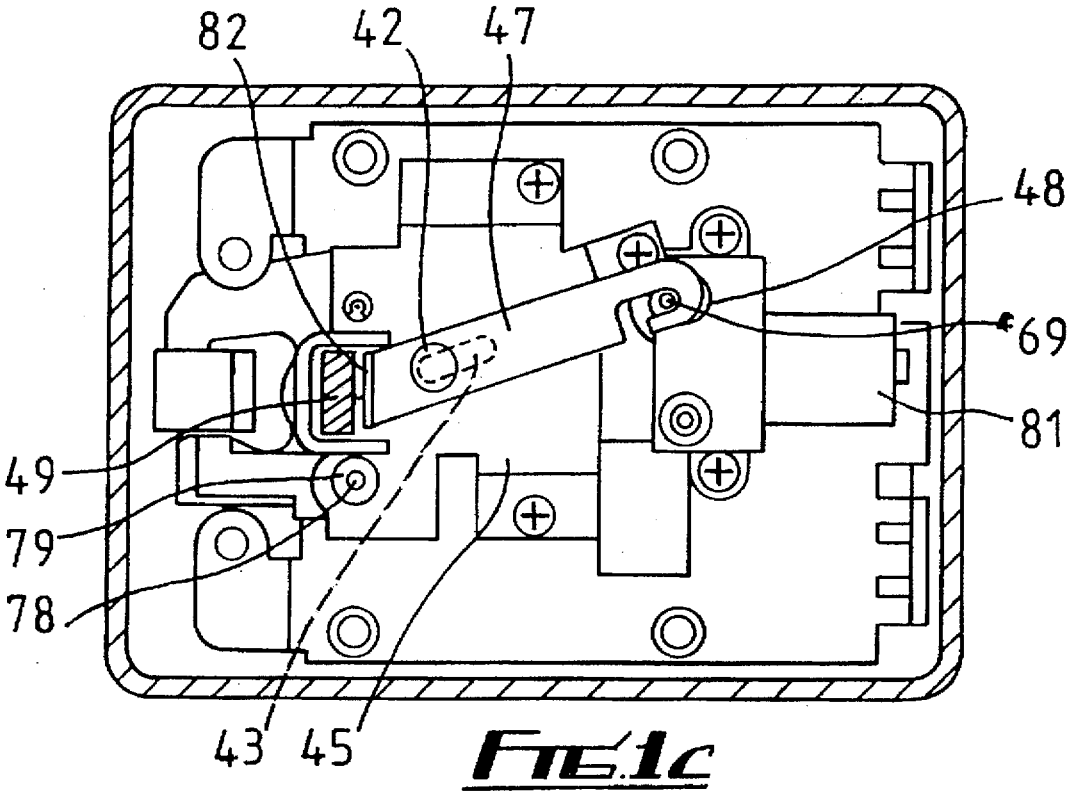
Figure 1D:
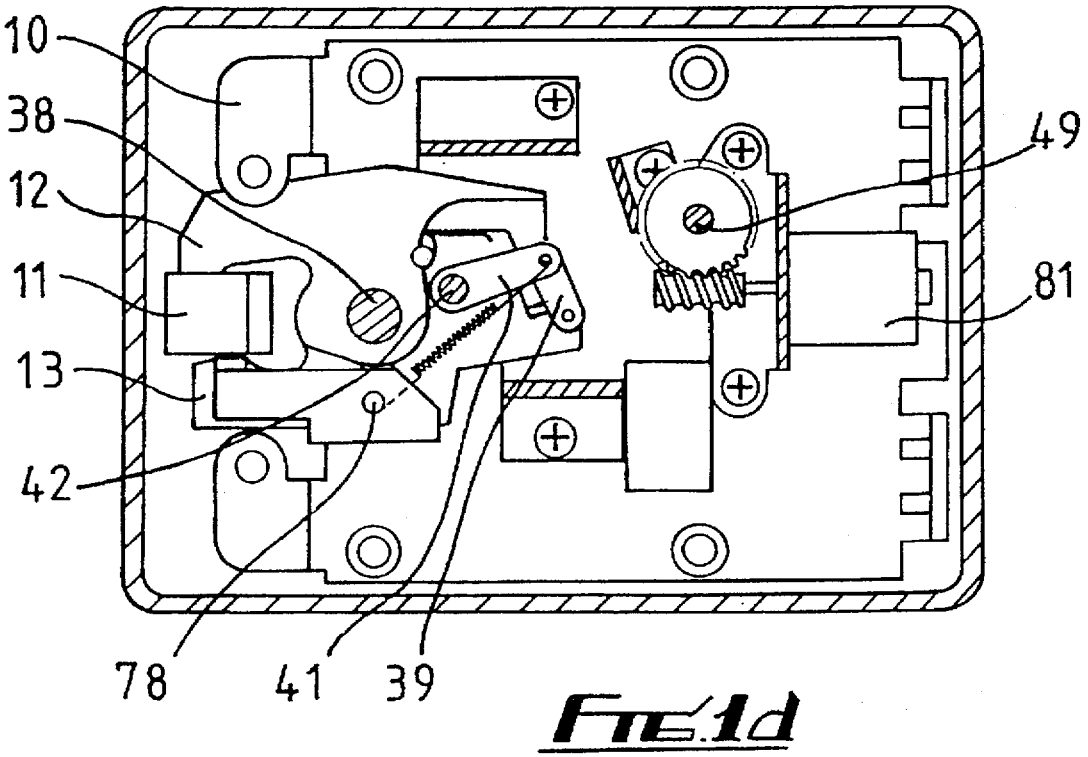

Referring to FIG. 1*d* the aperture 71 is maintained by abutment of a cam 39 pivotally mounted on the bar 13, against an abutment face of the bolt 12. Although the staple 11 is shown in a position central to the lock, limited misalignment is readily accommodated by the locking jaws rotating together on the pivot 38. This adjusts or centres the positioning of the jaws relative to the style whilst maintaining the aperture 71.

Rotation of the locking jaw is limited by movement of a retainer part 78, mounted on the bar 13, within a hole 79 in cap 45.

FIG. 1*c* shows a plan view of the lock with the link pin 42 extending above the cap 45 and mounted in a runner 47. The runner 47 is operatively connected to a crank pin 69 which is part of a crankshaft 48 driven by an electric motor 81 via a gear train.

The runner 47 has a form 82 to abut a handle 49 pivotally mounted in an extension of the cap 45.

Figure 2A:
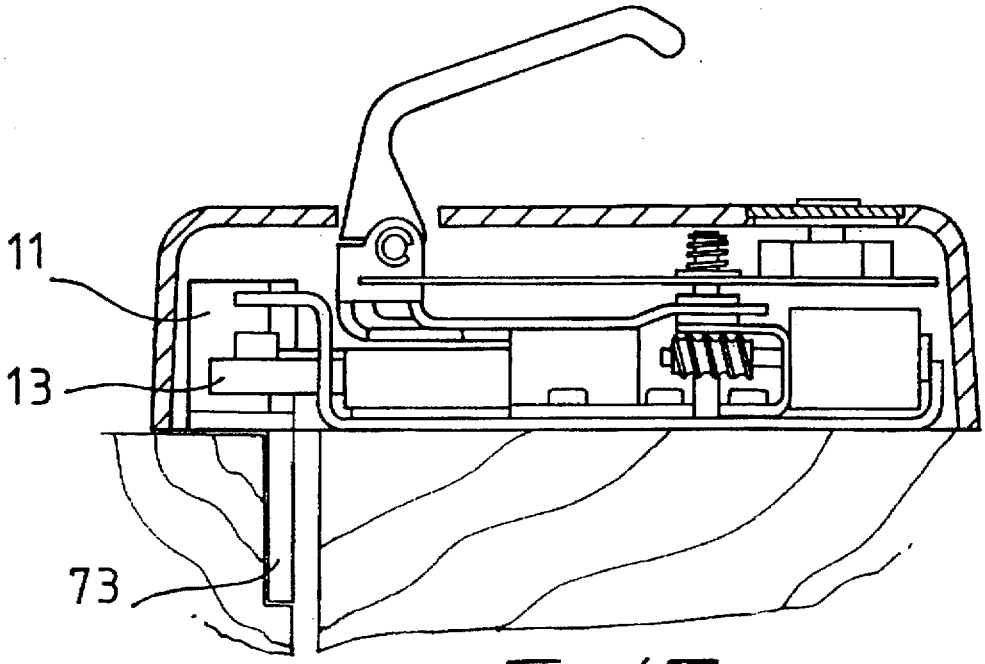
FIG. 2 shows the lock in an unlocked state, FIGS. 2*a* and 2*b* being views corresponding to FIG. 1*a* and 1*c*, and FIG. 2*c* being a detail view of an end of a crankshaft in an unlocked position.
Figure 2B:
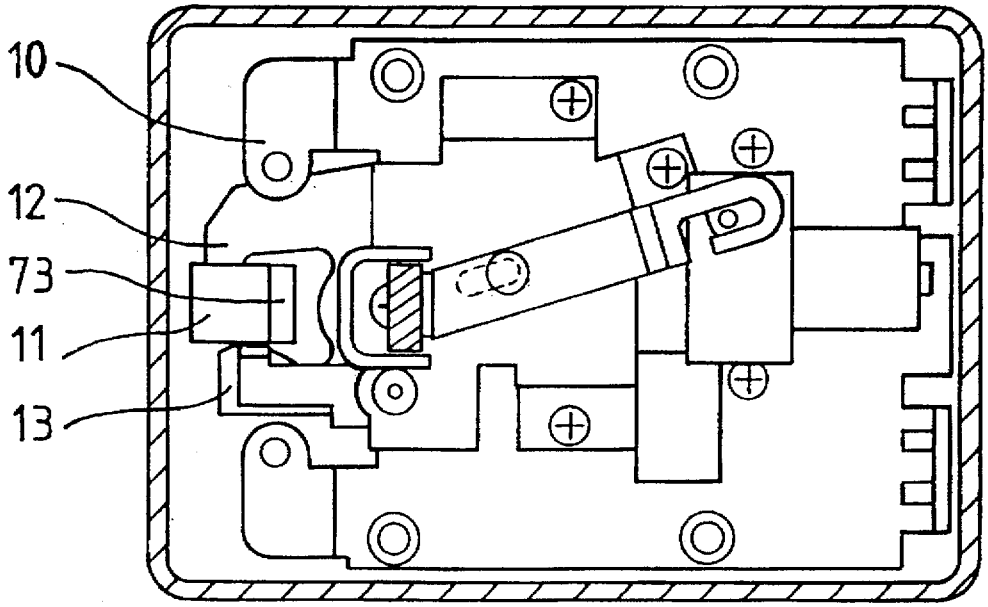
Figure 2C:
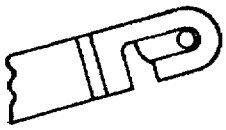

It will be seen that rotating the crankshaft 48 by a half turn to a predetermined position, or operating the handle 49 as shown in FIGS. 2*a* and 2*b*, will move the runner 47 and so move the link 41 to disengage the cam 39 from the abutment face, and that rotating the crankshaft 48 to the first position or releasing the handle 49 permits spring bias to reengage the cam 39 with the abutment face.

FIGS. 1*a* and 1*b* show a printed circuit board mounted in the lock with the crankshaft 48 extending through a hole. A contactor 55 is mounted relative to the crankshaft 48 and is operatively connected thereto by interlocking forms within the mounting. Spring bias ensures sufficient contact between the contactor 55 and tracks on the printed circuit board 60 without creating excessive friction.

The printed circuit board 60 also supports a seven segment display module 61 and two switches 62. A cover 64 has an aperture filled with a densely coloured plastic material 65 to permit viewing of the display when actuated but to obscure any view of the inside of the lock. Switch buttons 63 are slidably mounted through the cover 64 immediately above each switch 62 to enable operation of the switches 62 from outside the lock.

Figure 3C:
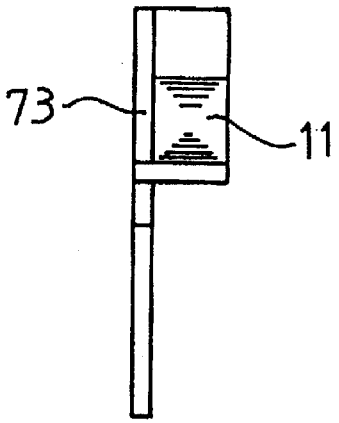
FIG. 3 Shows a staple mounted on a locking plate of the lock, FIG. 3*a* being a side view, FIG. 3*b* being an edge view from the top of FIG. 3*a*, and FIG. 3*c* being an end view from the left of FIG. 3*a*.
Figure 3A:
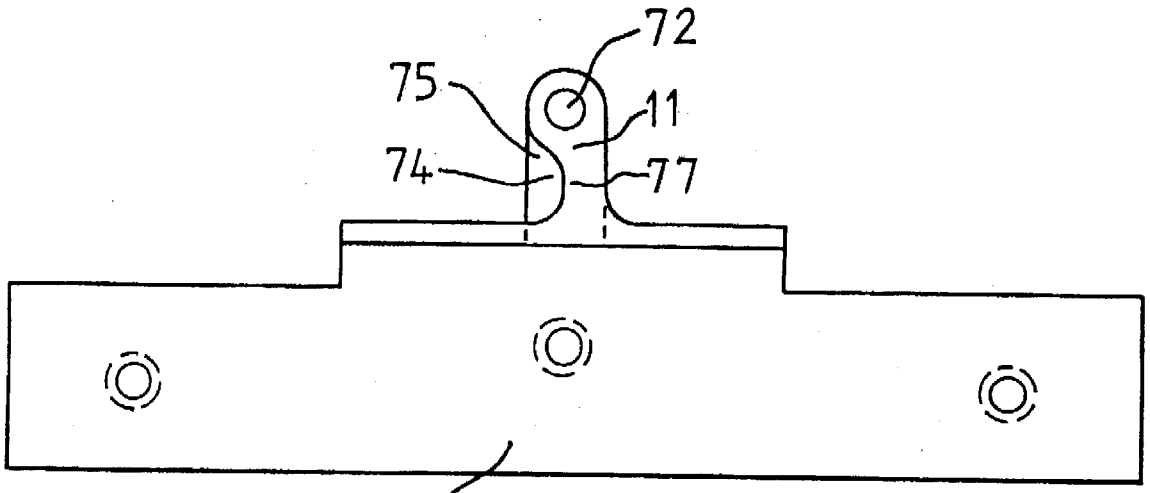
Figure 3B:
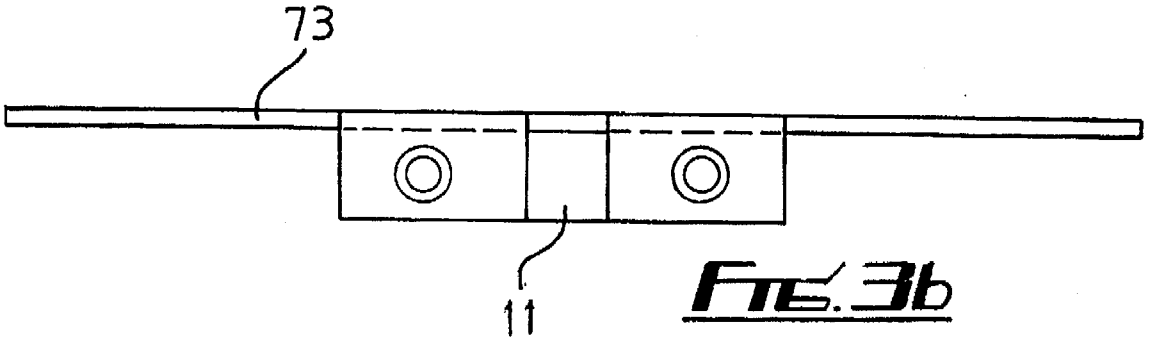

FIG. 3 shows the staple 11 and locking plate 73 joined by the rivet 72 to form a staple assembly for fixing to the door frame. The locking plate 73 assists in spreading any load created by attempts to force open the door.

An operational cycle will now be described.

Figure 4A:
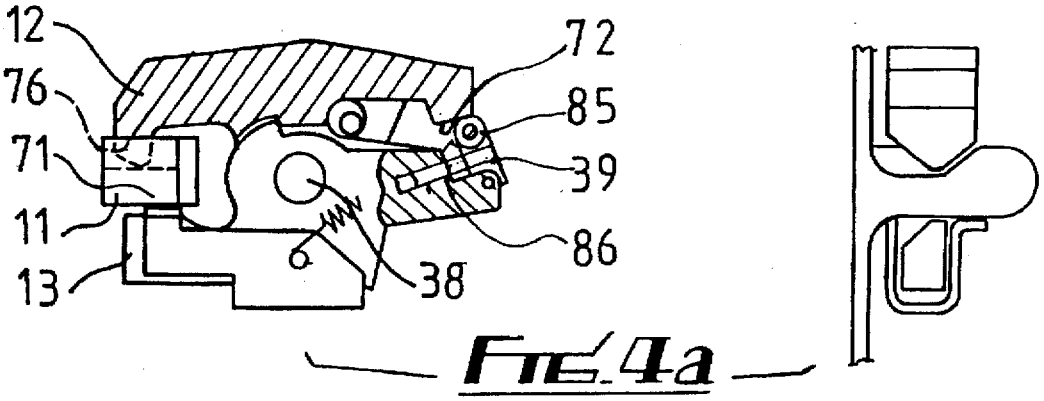
FIGS. 4*a–d* show parts of the lock in plan and side view at different operational positions in a cycle of operation thereof.
Figure 4B:
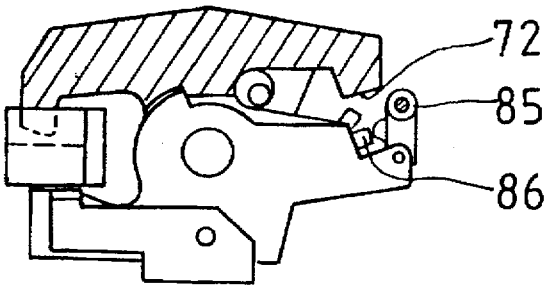

Referring to FIG. 4*a*, the staple 11 is imprisoned within the defined aperture 71 with a hook 76, formed as part of the bolt 12 engaged in a formed recess 74 in the staple 11. Any attempt to separate the door from the frame is resisted by abutment of the inside of the hook 76 against the extension 74 of the locking plate 73. The cam 39 is in abutment with the locking face 72 to maintain the defined aperture 71.

Fig, 4*b* shows the cam 39 moved to a second position out of abutment with the locking face by operation of the electric motor 81 or handle 49 as described above. Movement of the cam 39 to this second position may be impeded by friction if the staple 11 is in contact with the bolt 12, such as may arise due to a warped door or as a consequence of a person leaning on the door. To reduce such friction, the abutment point of the cam 39 may be equipped with a roller 85 rotatably mounted within the cam 39.

The angle of the cam 39 to the abutment face is important to ensure that the cam 39 cannot be shocked out of abutment by hammer blows to the door. A fine adjustment of the relative angle is assured by a cam stop screw 86 which limits the extent of spring biased movement of the cam 39 ensuring a positive locking angle without the cam 39 moving beyond a position perpendicular to the abutment face.

If the cam 39 travels past a perpendicular position a much greater force is required to move the cam 39 to the second position.

Figure 4C:
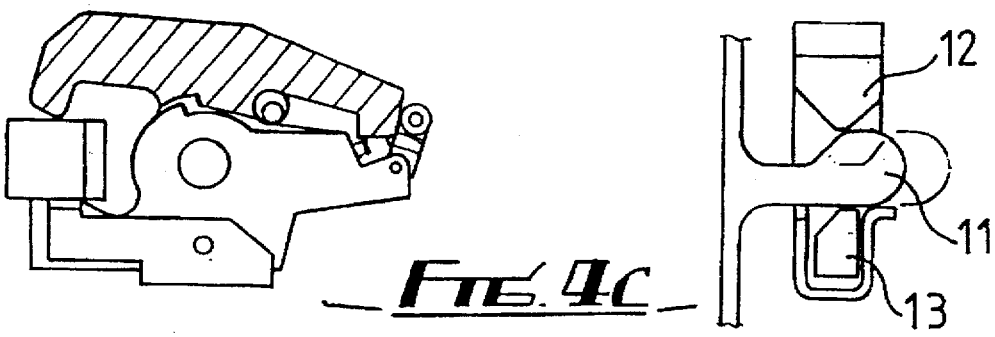

FIG. 4*c* shows the locking jaws opened by passage of the locking cam and interaction of a bevelled face on the bolt 12 with a radial form of the staple 11.

Figure 4D:
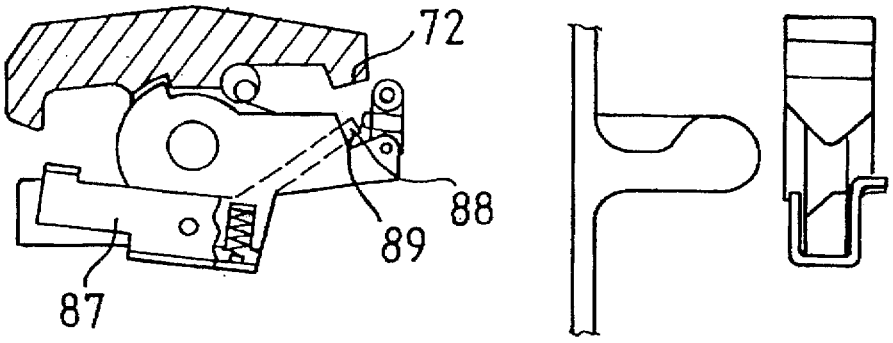
Figure 5:
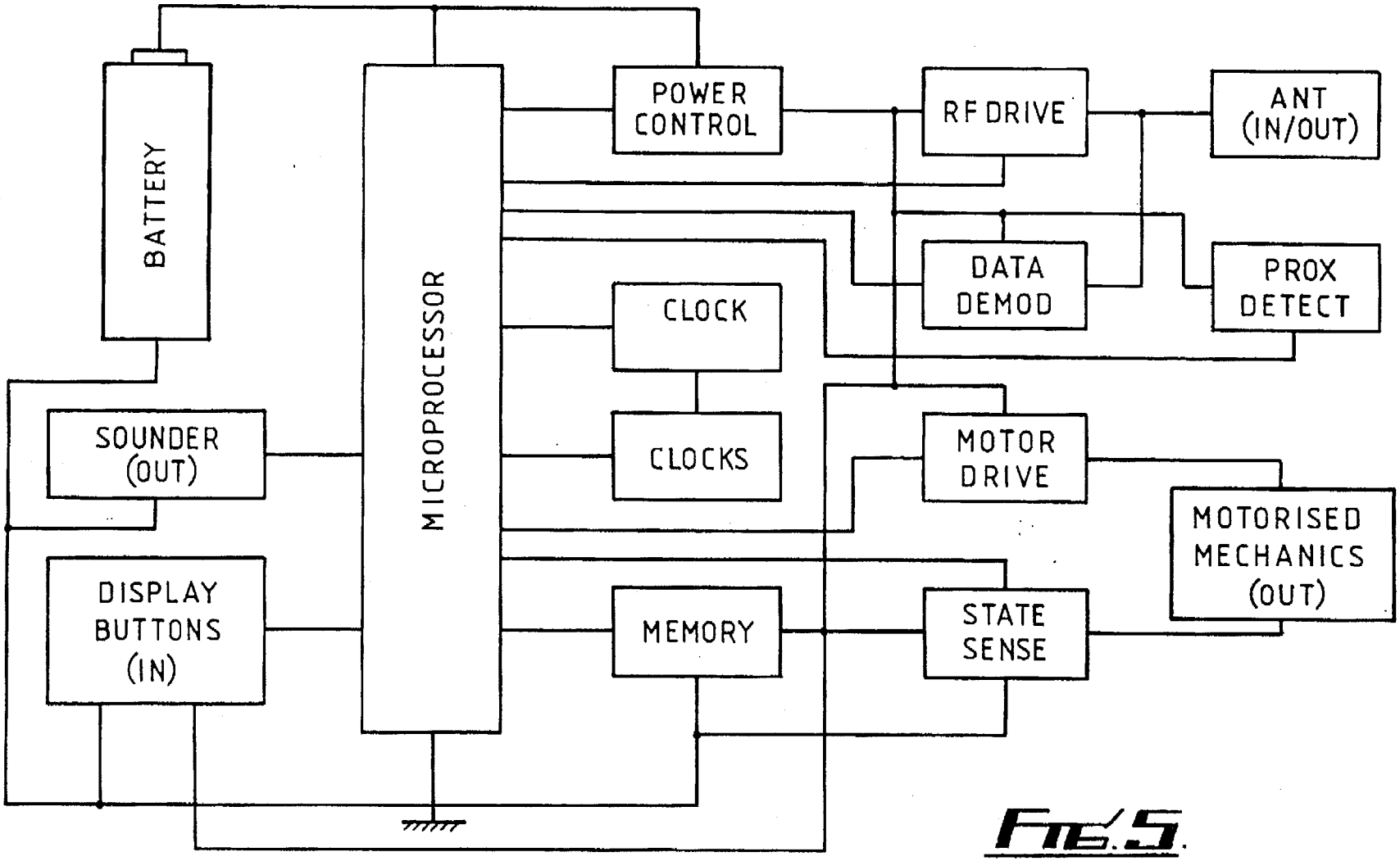
FIG. 5 is a block circuit diagram of the electronic operating system of the lock.

FIG. 4*d* shows the locking jaw spring urged to the first position but the cam 39 is held out of abutment with the locking face by rotation of a retainer 87 moving a retaining arm 89 into abutment with a projection of the cam 39.

The staple 11 is capable of engaging in the locking jaws without the need for operation of the handle 49 or crankshaft 48. The radial form on the outer end of the staple 11 interacts with the bevelled faces of the bolt 12 and bar 13 to open the jaw and allow passage of the staple 11 to the first position. The retainer 87 is rotated by the staple 11 moving the retaining arm 89 out of abutment with the cam face 88 and allowing the cam 39 to move to the first position.

Fig, 5 shows a block circuit diagram for the electronics on the printed circuit 60 of the lock, The electronic circuit controls operation of the low power motor 81 with an on-board battery.

The motor 81 can be driven through three stopping positions, determined by the contactor 55 and associated contacts, in which the lock is respectively in release, locked but openable on the inside with the handle, and, deadlocked. In the deadlocked position, the lock is locked but the position of the runner 47 is such that the range of movement of the handle is insufficient to release the lock.

Movement of the motor 81 between these positions is controlled by a coded proximity key which interacts inductively with the antenna or inductive coupling coil of a reader of the electronic circuit, and also by control buttons used in conjunction with the digital display on the inside of the lock.

When first installed, the first coded key presented to the reader becomes the master program key. Other keys with different codes can only be used with the lock after their codes have been stored in the electronic circuitry which involves actuating the circuitry with the master key and then appropriately operating the buttons and presenting a new key to the lock. In similar manner, keys can be de-authorised and their codes removed from memory.

With the lock locked or deadlocked as programmed using the buttons, unlocking occurs automatically by presenting an authorised key to the reader from the outside of the door. The door reverts to locked or deadlocked mode when subsequently closed.

When closed and locked, but not deadlocked, the lock can be opened on the inside with the handle.

When closed and deadlocked, the lock can be opened by entering a pre-set 4-digit code using the buttons and the digital display.

Conveniently the electronic drive, to the segments of the digital display may be invertible so that the display can be used either way up, corresponding to a left-hand or right-hand opening door. There may be an internal electronic setting or alternatively the buttons may be used to invert the display on installation.

With the above described embodiment, high security with simple and convenient manufacture, installation and use are achieved in the context of a low power electric lock which can be powered from an on-board dry cell. Reference is made to U.K. Patent application GB 9308718.7 for a description of a suitable low power proximity key system.

The lock hereinbefore described has a positive mechanism release action whereby when it is unlocked the door can be opened simply by pushing. It is not necessary to perform any further mechanical or manual operation such as turning a door knob.

Moreover, the reader, or at least the coupling coil or antenna thereof can comprise a compact preferably cylindrical portion projecting through a hole in the door to present e.g. a small disc-shaped surface for presentation of the code key thereto. This means that the lock can be readily fitted to a door in replacement for an existing conventional lock, the main lock housing being mounted at the rear or inside of the door and the projecting reader cylinder passing through the existing hole in the door which contained the cylinder of the conventional lock.

The security value of the lock may be devalued in installations with glazing in or near to the door enabling an intruder to break a pane of glass and operate the internal handle to open the door.

A conflict exists between the need to secure the handle against illicit operation and the need to maintain freedom of use of the handle for rapid escape in an emergency.

In some known types of mechanical locks the internal handle may be locked by a snib button mounted on the lock case. Not only can this be released by an intruder reaching through a broken pane, but, when engaged the snib also prevents key operation from outside the door preventing assistance reaching an occupant of the premises.

In other known types of locks an internal key mechanism may be mounted in the lock case to secure or release the handle. The internal key mechanism is not operatively connected to the external key mechanism and the handle must be released by a second operation of the key when the door has been opened. It is not unknown for a key holder to open a door and leave the key in the outside key mechanism on entering the premises. The door is then closed and locked by an automatic closer leaving the keyholder trapped inside since the handle has not been unlocked and the keys in the outside of the door vulnerable to theft.

In accordance with embodiments of this invention the handle may be secured against illicit operation by a sequence of deliberate actions to reduce the possibility of accidental or unwitting use and automatically released by operation of a key from outside or entry of a valid code via the switches of the lock case. Operation of the handle locking arrangement requires only a small amount of electrical energy.

Figure 6A:
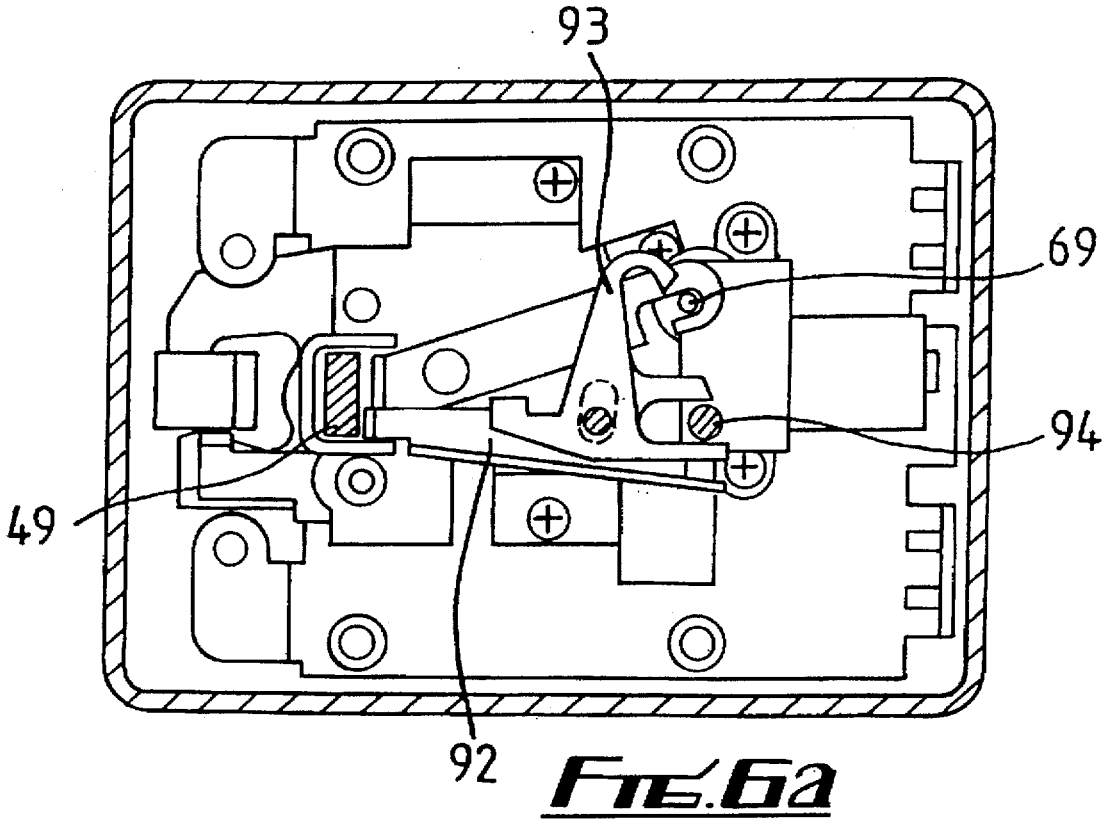
FIGS. 6*a–6c* are views of a modified embodiment.
Figure 6B:
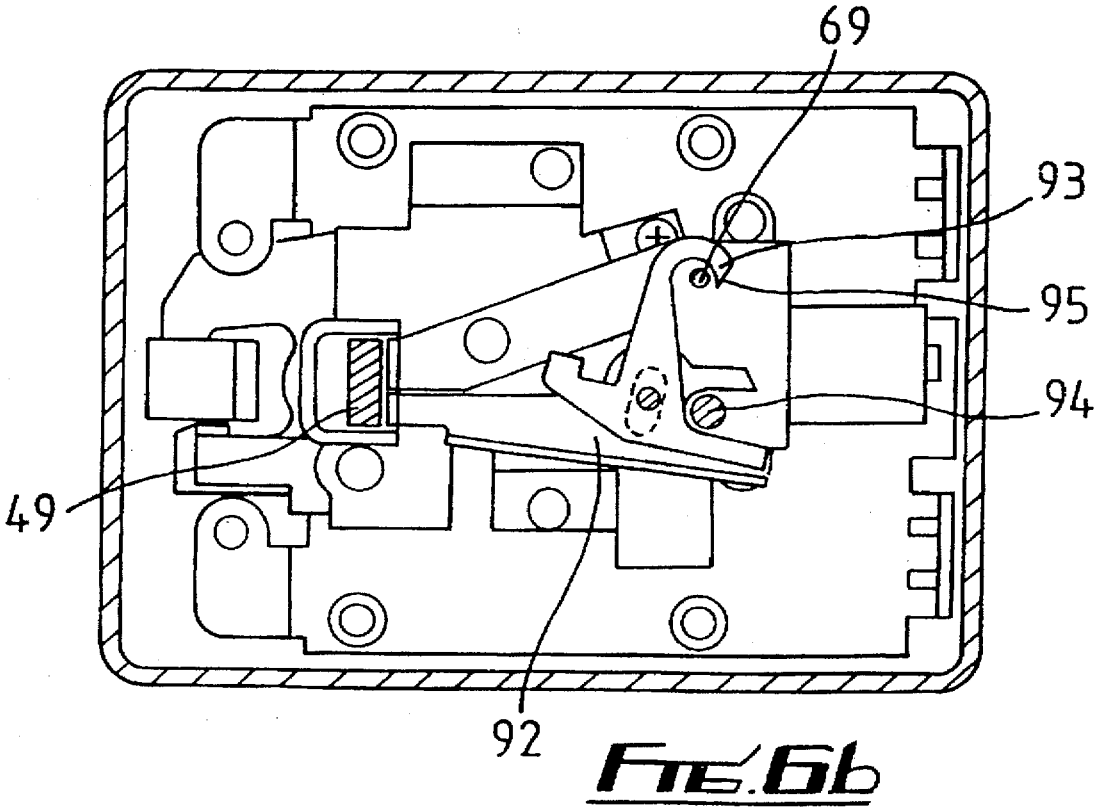
Figure 6C:
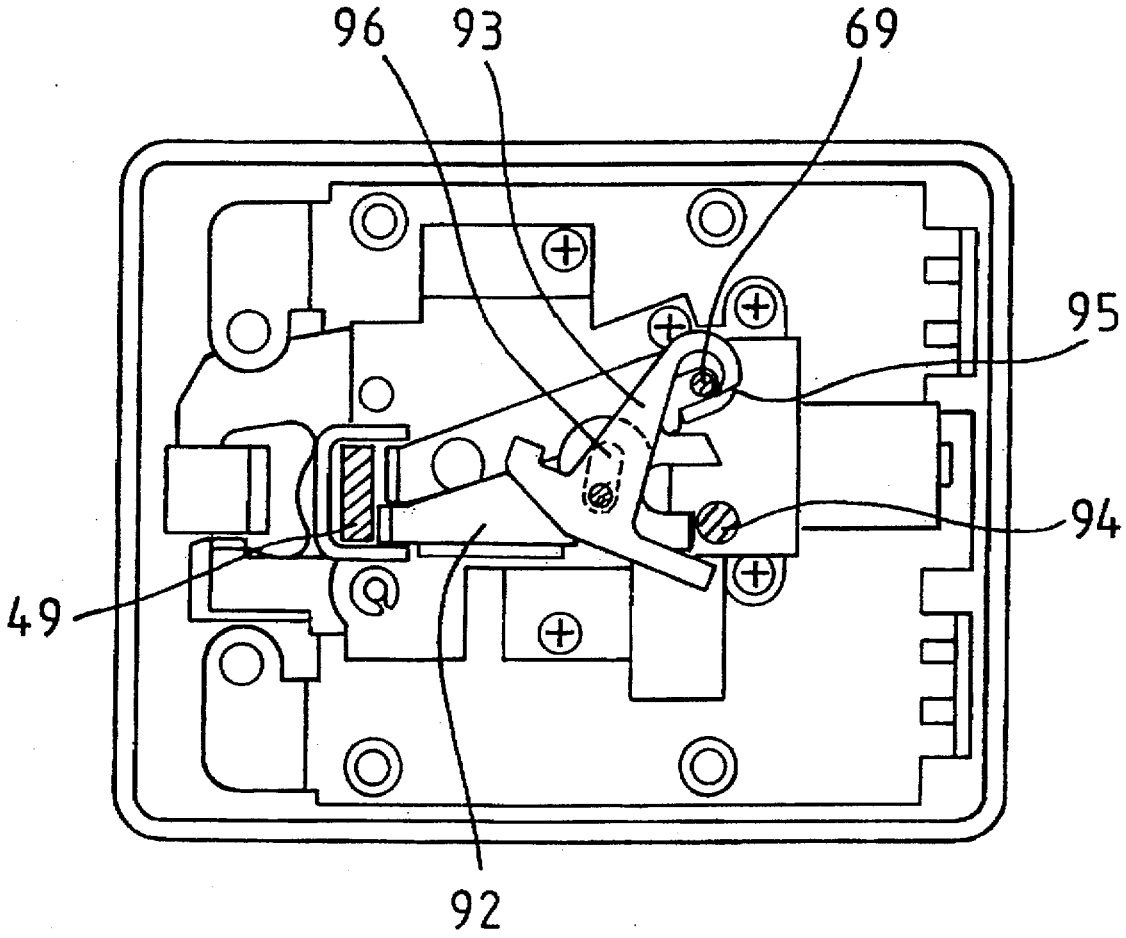

In this respect, referring to the accompanying drawings, FIG. 6(*a*) shows a lock with the handle securing arrangement disengaged permitting full operation of the handle to unlock the door.

To engage the handle securing arrangement the handle (49) is moved to the operated position and held in that position while a code is entered via the switch buttons causing the crank pin (69) to rotate to a third position and into engagement with a catch plate (93). The catch plate (93) is mounted on a blocking member (92) which is slidably mounted in the lock and operatively connected to the handle (49) as shown in FIG. 6(*b*).

The handle (49) is released and is spring urged to the unoperated position but the catch plate (93) remains in engagement with the crank pin (69) as shown in FIG. 6(*c*). The interaction of the engaged catch plate (93) and the blocking member (92) causes the blocking member (92) to slew into engagement with a guide post (94) rigidly mounted in the lock. Movement of the handle (49) is blocked by the abutment of the end of the blocking member (92) against the guide post (94). The arrangement of mounting the catch plate (93) on a post (95) which operates within a slot (96) in the blocking member (92) permits the relative attitudes of the catch plate (92) and the blocking member (93) to vary as the components move from unoperated to the operated position.

Operation of a key or entry of the code via the switches rotates the crank pin (69) to the second position, unlocking the mechanism. A flat on the crank pin (69) is presented to the engaging end (95) of the catch plate (93) permitting the catch plate (93) to ride over the crank pin (69), the catch plate (93) and blocking member (92) being spring urged to the unoperated position, releasing the handle.

With this arrangement, operation of the handle can only be blocked by a deliberate sequence of actions and knowledge of the lock code, and blocking of the handle is released by key operation from the outside of the door obviating the possibility of accidentally trapping personnel behind a door, or by code entry from inside.

We claim:

1. A lock mechanism comprising:

a pair of jaws movable towards and away from each other between a locking position at which a style or bolt is held captive between the jaws and a release position at which the style or bolt is free to be withdrawn from between the jaws;

a movable abutment member mounted on one of the jaws and movable with respect to the one of the jaws between a first position maintaining the jaws in the locking position and a second position permitting the jaws to move to the release position;

a mechanism moving the abutment member between its first and second positions; and a retainer operated by movement of the style or bolt from between the jaws to retain the abutment member in its second position so that the jaws can move to their release position.

2. A lock mechanism according to claim 1 wherein the jaws are movable transversely to a direction of withdrawal of the style or bolt.

3. A lock mechanism according to claim 1 wherein the jaws are pivotally movable towards and away from each other between the locking and release positions.

4. A lock mechanism according to claim 1 wherein the jaws are mounted for movement together about a common axis for adjustment of the positioning of the jaws in the locking position thereof relative to the style or bolt.

5. A lock mechanism according to claim 1 wherein one of the jaws has a hook shaped end portion for engagement with the style or bolt.

6. A lock mechanism according to claim 1 wherein one of the jaws has a bar-shaped end portion for engagement with the style or bolt.

7. A lock mechanism according to claim 1 wherein an end portion of at least one of the jaws has an inclined surface for sliding engagement with the style or bolt on movement thereof between the jaws to the retained position of the style or bolt.

8. A lock mechanism according to claim 1 wherein the style or bolt has a hooked end for engagement with the jaws.

9. A lock mechanism according to claim 8 wherein the hooked end of the style or bolt has a curved surface thereto.

10. A lock mechanism according to claim 1 wherein the abutment member is pivotable on the one of the jaws between its first and second positions.

11. A lock mechanism according to claim 10 wherein the abutment member contacts the other of the jaws in its first position.

12. A lock mechanism according to claim 11 wherein the abutment member includes a roller for contacting the other of the jaws when the abutment member is in its first position.

13. A lock mechanism according to claim 10 wherein the jaws are pivotable about a common axis between the locking and release positions, the one of the jaws has a first portion for contacting the style or bolt, and the abutment member is pivotably mounted on a second portion of the one of the jaws on an opposite side of the common axis from the first portion.

14. A lock mechanism according to claim 1 including a biasing member biasing the abutment member towards its first position.

15. A lock mechanism according to claim 1 wherein the mechanism for moving the abutment member comprises an elongated runner movable to move the abutment member from its first to its second position.

16. A lock mechanism according to claim 15 including an electrically operable device operatively connected to the runner for moving the runner.

17. A lock mechanism according to claim 16 wherein the electrically operable device is a motor.

18. A lock mechanism according to claim 16 including an electronic control circuit for the electrically operable device, which circuit is actuable by an electronic coded proximity key.

19. A lock mechanism according to claim 18 wherein the key is arranged to be inductively read by the control circuit.

20. A lock mechanism according to claim 16 including a battery power source for the electrically operable device.

21. A lock mechanism according to claim 16 including an electronic control circuit for the electrically operable device, which circuit is actuable by a manual control and which has a visual display device.

22. A lock mechanism according to claim 21 wherein the control circuit is operable to invert the presentation of the display of the display device.

23. A lock mechanism according to claim 16 including a manually operable handle operatively connected to the runner for moving the runner, the runner being movable by either the electrically operable device or the handle.

24. A lock mechanism comprising:

a pair of jaws movable towards and away from each other between a locking position at which a style or bolt is held captive between the jaws and a release position at which the style or bolt is free to be withdrawn from between the jaws;

a movable abutment member mounted on one of the jaws and movable with respect to the one of the jaws between a first position maintaining the jaws in the locking position and a second position permitting the jaws to move to the release position;

an electric motor;

an elongated runner having a first portion operatively connected to the abutment member and a second portion operatively connected to the electric motor and movable by the motor to move the abutment member between its first and second positions, the runner having a first position corresponding to a locked condition of the jaws in which the abutment member is in its first position, a second position corresponding to a dead-locked condition of the jaws in which the abutment member is in its first position, and a third position corresponding to a released condition of the jaws in which the abutment member is in its second position; and a mechanical actuator which is manually operable to move the runner from its first position to its third position but not from its second position to its third position.

25. A lock mechanism according to claim 24 wherein the motor has three operational positions corresponding to the three positions of the runner and defined by engagement of a contactor driven by the motor with electrical contacts of an electronic control circuit for the motor.

26. A lock mechanism according to claim 24 wherein the mechanical actuator comprises a handle.

27. A lock arrangement comprising:

a frame;

a closure pivotably mounted on the frame for movement with respect to the frame between an open position and a closed position closing an opening defined by the frame;

an engaging member mounted on one of the closure and the frame;

first and second jaws mounted on the other of the closure and the frame for pivoting about a common axis towards and away from each other between an open and a closed position, the jaws engaging with the engaging member when the jaws and the closure are in their closed positions;

an abutment member mounted on the first jaw and pivotable with respect to the first jaw between a first position preventing the jaws from opening and a second position permitting the jaws to open; and a retainer adjoining one of the jaws and pivotable between a first position spaced from the abutment member and a second position contacting the abutment member in its second position and preventing the abutment member from rotating to its first position.

28. A lock arrangement according to claim 27 wherein the engaging member comprises a staple mounted on the frame.

29. A lock arrangement according to claim 27 including a motor operatively connected to the abutment member to pivot the abutment member between its first and second positions.

30. A lock arrangement according to claim 27 including a biasing member biasing the retainer to its second position, the retainer being pivoted to its first position against a biasing force of the biasing member by contact with the engaging member when the engaging member is inserted between the jaws.

31. A lock arrangement according to claim 27 wherein the closure comprises a door and the frame comprises a door frame.

32. A lock arrangement according to claim 27 wherein the abutment member has an end spaced from the first jaw and opposing the second jaw when the abutment member is in its first position.

33. A lock arrangement according to claim 32 wherein the end of the abutment member contacts the second jaw when the abutment member is in its first position.

* * * * *